US006612454B1

(12) United States Patent
Lin

(10) Patent No.: US 6,612,454 B1
(45) Date of Patent: Sep. 2, 2003

(54) MODULE CONTAINER

(76) Inventor: Yi-Hung Lin, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/377,517

(22) Filed: Feb. 26, 2003

(65) Prior Publication Data

(65)

(51) Int. Cl.[7] ..... B65D 21/02
(52) U.S. Cl. ..... 220/23.88; 220/528; 220/788
(58) Field of Search ..... 220/23.88, 528, 220/788, 784

(56) References Cited

U.S. PATENT DOCUMENTS 2,944,694 A * 7/1960 Kinsey ..... 206/541
4,646,628 A * 3/1987 Lederman ..... 99/413
5,118,173 A * 6/1992 Proctor et al. ..... 312/213
6,189,330 B1 * 2/2001 Retallick et al. ..... 62/371
6,494,336 B1 * 12/2002 Bylo ..... 220/23.88

* cited by examiner

*Primary Examiner*—Joseph M. Moy

(57) ABSTRACT

A module container has a main body, a tray, and a cover. The main body has a periphery flange and a plurality of block ribs. The tray has a panel and a pair of separation bars to form a cross, and the panel and the separation bars defining four chambers to receive four inner boxes. The cover has a plurality of click ribs to match the block ribs of the main body. The tray is disposed in the main body. The cover is disposed on the main body. The periphery flange of the main body blocks the cover. Each click rib engages with the corresponding block rib.

5 Claims, 4 Drawing Sheets

MODULE CONTAINER

BACKGROUND OF THE INVENTION

The present invention relates to a module container. More particularly, the present invention relates to a module container which receives a plurality of inner boxes.

A conventional container has a main body and a cover covering the main body. However, the conventional container contains a single kind of articles only.

SUMMARY OF THE INVENTION

An object of the present invention is to provide a module container which has a tray to receive a plurality of inner boxes and each of the inner boxes contains one kind of article.

Another object of the present invention is to provide a module container which has a tray having a panel to be held by a user conveniently.

Accordingly, a module container comprises a main body, a tray, a first inner box, a second inner box, a third inner box, a fourth inner box, and a cover. The main body has a periphery flange and a plurality of block ribs. The tray has a panel and a pair of separation bars to form a cross, and the panel and the separation bars defining a first chamber, a second chamber, a third chamber, and a fourth chamber. The cover has a plurality of click ribs to match the block ribs of the main body. The first chamber receives the first inner box. The second chamber receives the second inner box. The third chamber receives the third inner box. The fourth chamber receives the fourth inner box. The tray is disposed in the main body. The cover is disposed on the main body. The periphery flange of the main body blocks the cover. Each of the click ribs engages with the corresponding block rib.

DETAILED DESCRIPTION OF THE INVENTION

Figure 1:
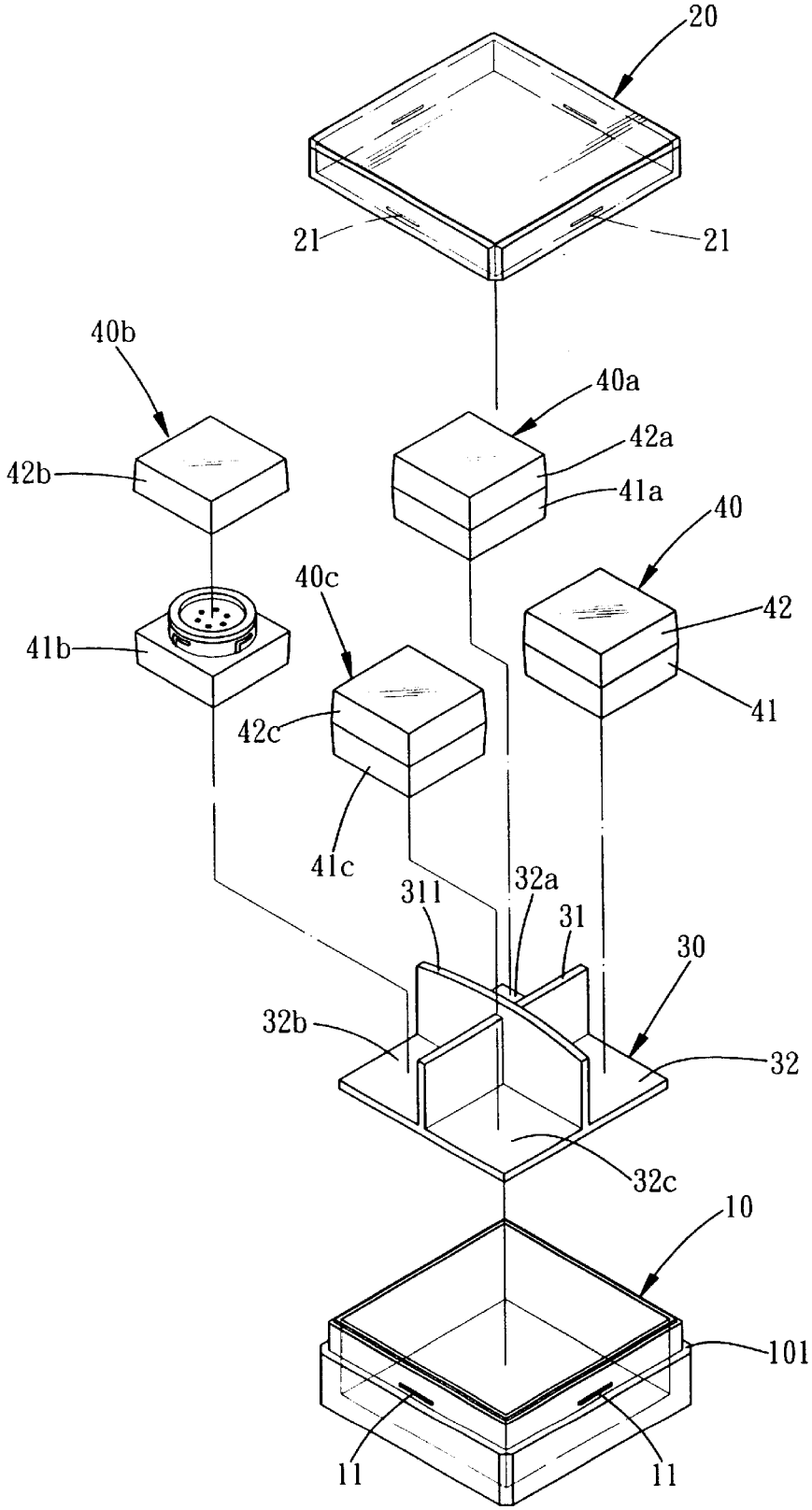
FIG. 1 is a perspective exploded view of a module container of a preferred embodiment in accordance with the present invention.
Figure 2:
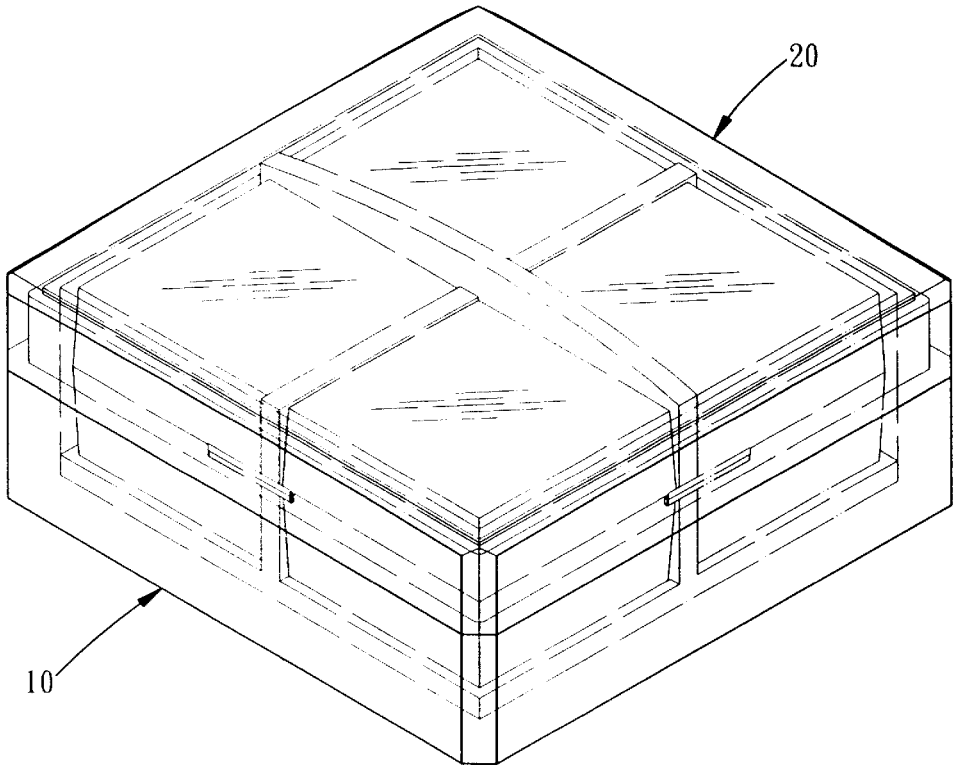
FIG. 2 is a perspective assembly view of a module container of a preferred embodiment in accordance with the present invention.
Figure 3:
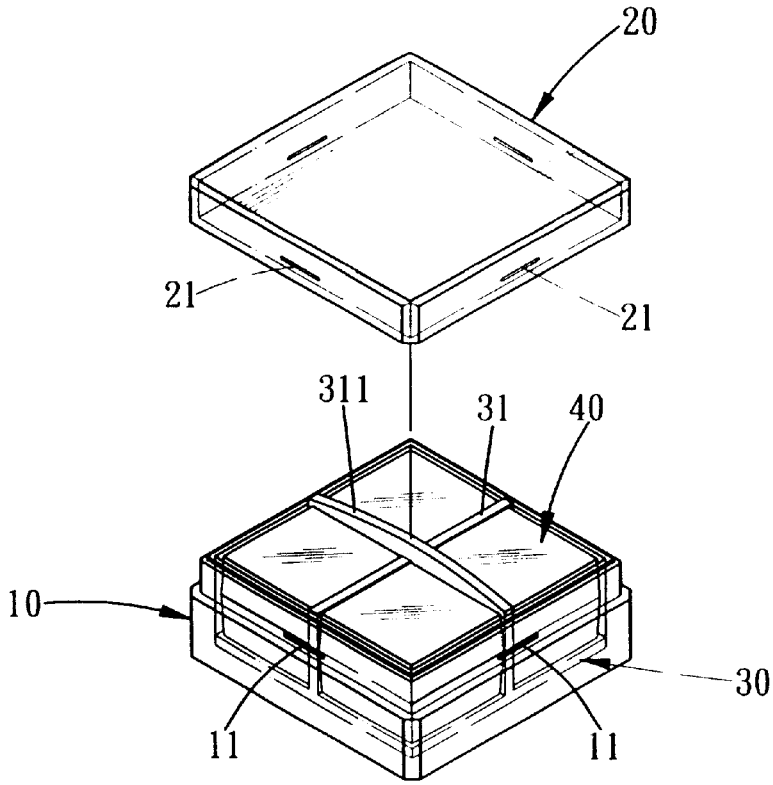
FIG. 3 is a perspective schematic view illustrating a cover of a preferred embodiment being detached.
Figure 4:
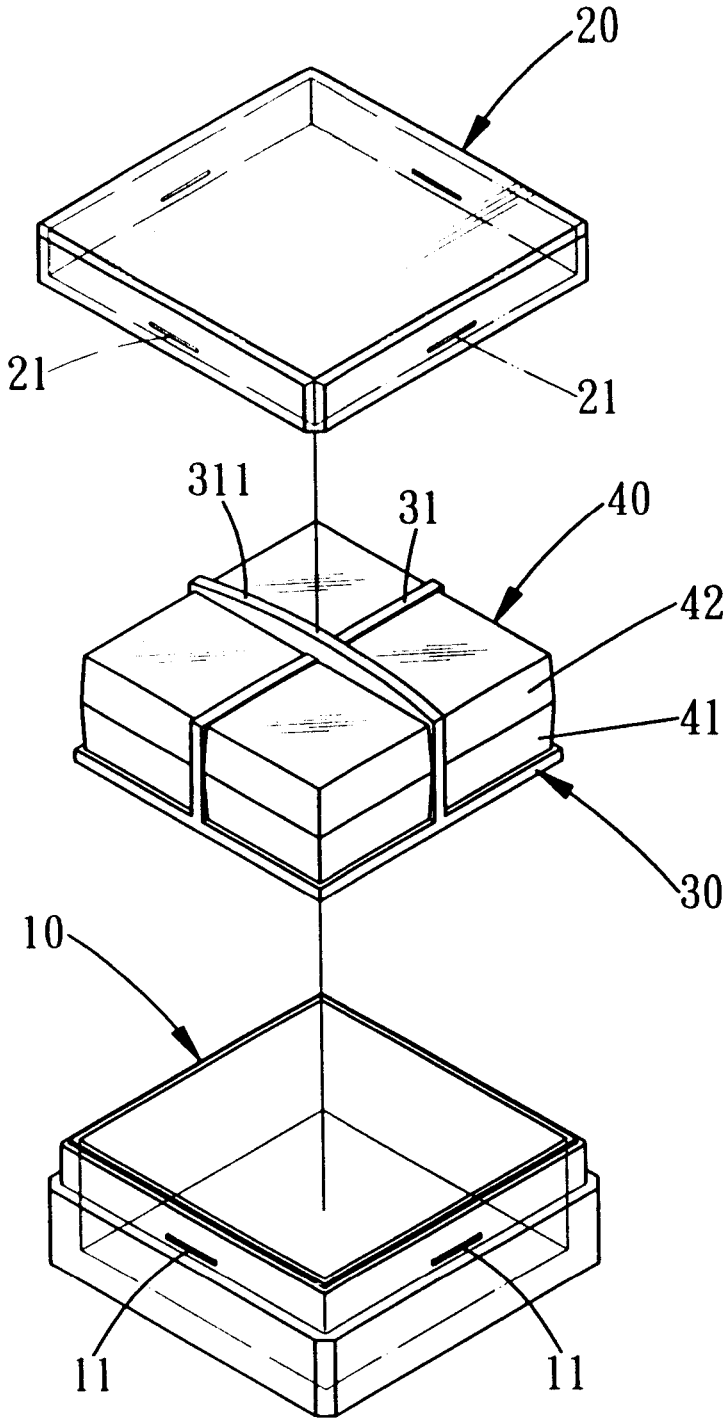
FIG. 4 is a perspective schematic view illustrating a cover and a tray of a preferred embodiment being detached.

Referring to FIGS. 1 to 4, a module container comprises a main body 10, a tray 30, a first inner box 40, a second inner box 40*a*, a third inner box 40*b*, a fourth inner box 40*c*, and a cover 20.

The main body 10 has a periphery flange 101 and a plurality of block ribs 11.

The tray 30 has a panel 311 and a pair of separation bars 31 to form a cross, and the panel 311 and the separation bars 31 defining a first chamber 32, a second chamber 32*a*, a third chamber 32*b*, and a fourth chamber 32*c*.

The cover 20 has a plurality of click ribs 21 to match the block ribs 11 of the main body 10.

The first chamber 32 receives the first inner box 40.

The second chamber 32*a* receives the second inner box 40*a*.

The third chamber 32*b* receives the third inner box 40*b*.

The fourth chamber 32*c* receives the fourth inner box 40*c*.

The tray 30 is disposed in the main body 10.

The cover 20 is disposed on the main body 10.

The periphery flange 101 of the main body 10 blocks the cover 20.

Each of the click ribs 21 engages with the corresponding block rib 11.

The first inner box 40 has a first base plate 41 and a first lid 42 disposed on the first base plate 41.

The second inner box 40*a* has a second base plate 41*a* and a second lid 42*a* disposed on the second base plate 41*a*.

The third inner box 40*b* has a third base plate 41*b* and a third lid 42*b* disposed on the third base plate 41*b*.

The fourth inner box 40*c* has a fourth base plate 41*c* and a fourth lid 42*c* disposed on the fourth base plate 41*c*.

Referring to FIGS. 3 and 4 again, the cover 20 is removed. The tray 30 is detached from the main body 10. Then the first inner box 40, the second inner box 40*a*, the third inner box 40*b*, and the fourth inner box 40*c* will be removed from the tray 30.

The invention is not limited to the above embodiment but various modification thereof may be made. Further, various changes in form and detail may be made without departing from the scope of the invention.

I claim:

1. A module container comprises:

a main body, a tray, a first inner box, a second inner box, a third inner box, a fourth inner box, and a cover, the main body having a periphery flange and a plurality of block ribs, the tray having a panel and a pair of separation bars to form a cross, and the panel and the separation bars defining a first-chamber, a second chamber, a third chamber, and a fourth chamber, the cover having a plurality of click ribs to match the block ribs of the main body, the first chamber receiving the first inner box, the second chamber receiving the second inner box, the third chamber receiving the third inner box, the fourth chamber receiving the fourth inner box, the tray disposed in the main body, the cover-disposed on the main body, the periphery flange of the main body blocking the cover, and each of the click ribs engaging with the corresponding block rib.

2. The module container as claimed in claim 1, wherein the first inner box has a base plate and a lid disposed on the base plate.

3. The module container as claimed in claim 1, wherein the second inner box has a base plate and a lid disposed on the base plate.

4. The module container as claimed in claim 1, wherein the third inner box has a base plate and a lid disposed on the base plate.

5. The module container as claimed in claim 1, wherein the fourth inner box has a base plate and a lid disposed on the base plate.

* * * * *